US011852126B2

(12) United States Patent
Gotanda et al.

(10) Patent No.: US 11,852,126 B2
(45) Date of Patent: Dec. 26, 2023

(54) CRYOPUMP SYSTEM, AND CONTROL DEVICE AND REGENERATION METHOD FOR CRYOPUMP SYSTEM

(71) Applicant: SUMITOMO HEAVY INDUSTRIES, LTD., Tokyo (JP)

(72) Inventors: Shuhei Gotanda, Tokyo (JP); Kakeru Takahashi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 286 days.

(21) Appl. No.: 17/212,562

(22) Filed: Mar. 25, 2021

(65) Prior Publication Data

US 2021/0301805 A1 Sep. 30, 2021

(30) Foreign Application Priority Data

Mar. 26, 2020 (JP) ..... 2020-056300

(51) Int. Cl.

| | |
|---|---|
| ***F04B 37/08*** | (2006.01) |
| ***F04B 41/06*** | (2006.01) |
| ***F04B 49/22*** | (2006.01) |
| ***F04B 49/06*** | (2006.01) |
| ***F04D 19/04*** | (2006.01) |

(Continued)

(52) U.S. Cl.

CPC ..... *F04B 37/085* (2013.01); *F04B 37/08* (2013.01); *F04B 41/06* (2013.01); *F04B 49/00* (2013.01); *F04B 49/065* (2013.01); *F04B 49/225* (2013.01); *F04D 19/04* (2013.01);

(Continued)

(58) Field of Classification Search

CPC ..... F04B 37/08; F04B 37/085; F04B 49/065; F04B 41/06; F04B 49/06; F04B 49/225; F04B 2205/04; F04B 2205/11; Y10S 417/901; F04D 19/04; F04D 27/00

See application file for complete search history.

(56) References Cited

U.S. PATENT DOCUMENTS 5,176,004 A * 1/1993 Gaudet ..... F04B 37/08 62/55.5

5,265,431 A * 11/1993 Gaudet ..... F04B 37/08 62/126

(Continued)

FOREIGN PATENT DOCUMENTS

JP 2013-060853 A 4/2013

*Primary Examiner* — Peter J Bertheaud

(74) *Attorney, Agent, or Firm* — Michael Best & Friedrich LLP

(57) ABSTRACT

A cryopump system includes a plurality of cryopumps, each cryopump including a rough valve connecting the cryopump to a common rough pump and a pressure sensor measuring a pressure in the cryopump, and a controller that controls, for each cryopump, the rough valve based on a measured pressure from the pressure sensor such that the cryopump is decompressed to a first reference pressure by the common rough pump and thereafter a vacuum is maintained in the cryopump, and the cryopump is further decompressed to a second reference pressure lower than the first reference pressure by the common rough pump. The controller is configured to, based on the measured pressure from the pressure sensor of a first cryopump, open the rough valve of a second cryopump such that the second cryopump is decompressed to the first reference pressure while the vacuum is maintained in the first cryopump.

10 Claims, 7 Drawing Sheets

(51) Int. Cl.
*F04D 27/00* (2006.01)
*F04B 49/00* (2006.01)

(52) U.S. Cl.
CPC ..... *F04D 27/00* (2013.01); *F04B 2205/04* (2013.01); *F04B 2205/11* (2013.01); *Y10S 417/901* (2013.01)

(56) References Cited

U.S. PATENT DOCUMENTS 8,874,274 B2 * 10/2014 McDonald ..... G05B 9/02 700/282
8,959,933 B2 * 2/2015 Ando ..... F04B 37/08 62/55.5
10,393,099 B2 * 8/2019 Yatsu ..... F04B 49/065

* cited by examiner

FIG. 4

41

| ORDER | CRYOPUMP |
|---|---|
| 1 | CRYOPUMP (3) |
| 2 | CRYOPUMP (2) |
| 3 | CRYOPUMP (1) |
| 4 | CRYOPUMP (4) |

42

| ORDER | CRYOPUMP |
|---|---|
| 1 | CRYOPUMP (4) |
| 1 | CRYOPUMP (1) |
| 2 | CRYOPUMP (2) |
| 2 | CRYOPUMP (3) |

20

CRYOPUMP SYSTEM, AND CONTROL DEVICE AND REGENERATION METHOD FOR CRYOPUMP SYSTEM

RELATED APPLICATIONS

The content of Japanese Patent Application No. 2020-056300, on the basis of which priority benefits are claimed in an accompanying application data sheet, is in its entirety incorporated herein by reference.

BACKGROUND

Technical Field

Certain embodiments of the present invention relate to a cryopump system, and a control device and a regeneration method for a cryopump system.

Description of Related Art

A cryopump is a vacuum pump that captures gas molecules through condensation and adsorption on a cryopanel and pumps the gas molecules cooled to a cryogenic temperature. The cryopump is used in general in order to realize a clean vacuum environment required for semiconductor circuit manufacturing processes. Since the cryopump is a so-called gas storage type vacuum pump, regeneration in which the captured gas is periodically removed to the outside is required.

SUMMARY

According to an aspect of the present invention, there is provided a cryopump system including a plurality of cryopumps, each cryopump including a rough valve connecting the cryopump to a common rough pump and a pressure sensor measuring a pressure in the cryopump, and a controller that controls, for each of the plurality of cryopumps, the rough valve of the cryopump based on a measured pressure from the pressure sensor of the cryopump, such that the cryopump is decompressed to a first reference pressure by the common rough pump and thereafter a vacuum is maintained in the cryopump, and the cryopump is further decompressed to a second reference pressure lower than the first reference pressure by the common rough pump. The controller is configured to, based on the measured pressure from the pressure sensor of a first one of the cryopumps, open the rough valve of a second one of the cryopumps such that the second one of the cryopumps is decompressed to the first reference pressure while the vacuum is maintained in the first one of the cryopumps.

According to another aspect of the present invention, there is provided a control device for a cryopump system. The cryopump system includes a plurality of cryopumps connected to a common rough pump. The control device includes a controller configured such that the plurality of cryopumps are consecutively decompressed to a first reference pressure by the common rough pump and thereafter a vacuum is maintained in the cryopumps decompressed to the first reference pressure, and the plurality of cryopumps are further decompressed to a second reference pressure lower than the first reference pressure by the common rough pump. The controller is configured to decompress one of the plurality of cryopumps to the first reference pressure while the vacuum is maintained in another cryopump of the plurality of cryopumps.

According to still another aspect of the present invention, there is provided a regeneration method for a cryopump system. The cryopump system includes a plurality of cryopumps connected to a rough pump. The regeneration method includes decompressing the plurality of cryopumps consecutively to a first reference pressure with the rough pump, maintaining a vacuum in the cryopumps decompressed to the first reference pressure, and further decompressing the plurality of cryopumps to a second reference pressure lower than the first reference pressure with the rough pump. The decompressing to the first reference pressure includes decompressing one of the plurality of cryopumps to the first reference pressure while the vacuum is maintained in another cryopump of the plurality of cryopumps.

BRIEF DESCRIPTION OF THE DRAWINGS

FIG. 4 is a table showing an example of a waiting list according to the embodiment.

DETAILED DESCRIPTION

It is desirable to shorten regeneration time of a cryopump system.

Any combination of the components described above and a combination obtained by switching the components and expressions of the present invention between methods, devices, and systems are also effective as an aspect of the present invention.

Hereinafter, an embodiment for carrying out the present invention will be described in detail with reference to the drawings. In the description and drawings, the same or equivalent components, members, and processing will be assigned with the same reference symbols, and redundant description thereof will be omitted as appropriate. The scales and shapes of the illustrated parts are set for convenience in order to make the description easy to understand, and are not to be understood as limiting unless stated otherwise. The embodiment is merely an example and does not limit the scope of the present invention. All characteristics and combinations to be described in the embodiment are not necessarily essential to the invention.

Figure 1:
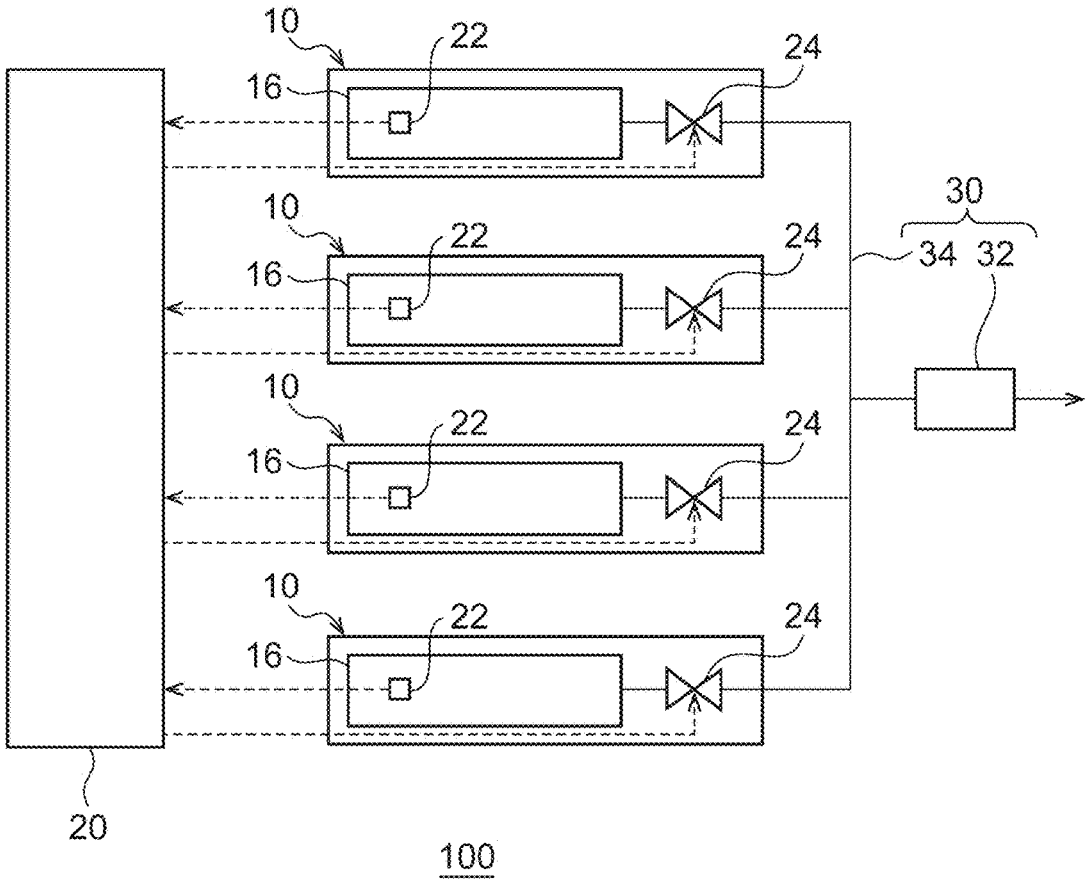
FIG. 1 is a diagram schematically showing a cryopump system according to an embodiment.
Figure 2:
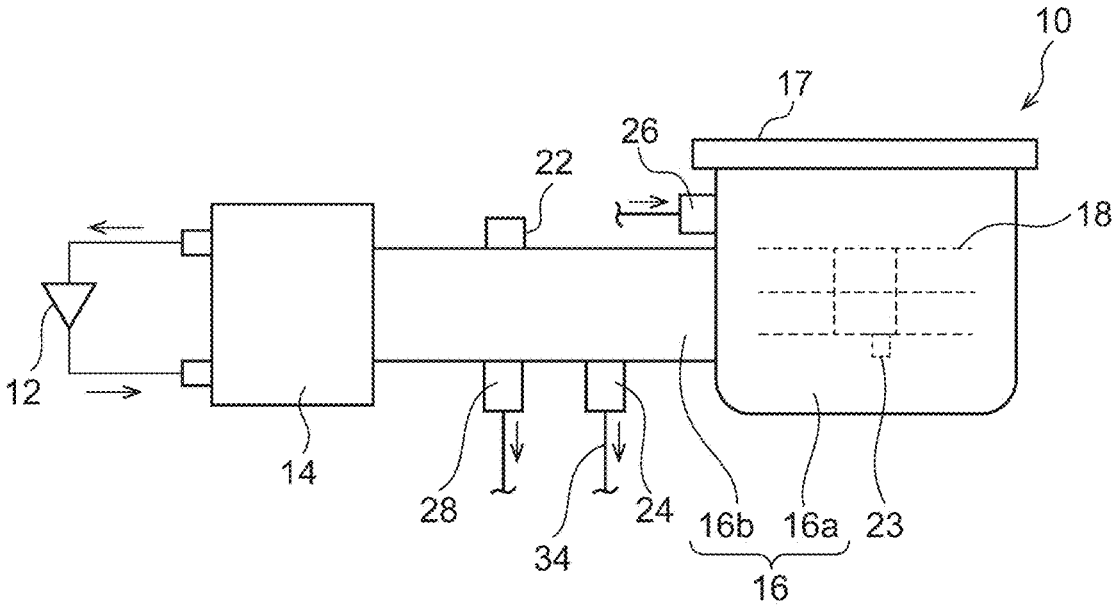
FIG. 2 is a diagram schematically showing a cryopump of the cryopump system shown in FIG. 1.

FIG. 1 is a diagram schematically showing a cryopump system according to the embodiment. FIG. 2 is a diagram schematically showing a cryopump of the cryopump system shown in FIG. 1.

A cryopump system 100 includes a plurality of cryopumps 10 and a controller 20 that controls the cryopumps 10. The cryopump 10 is attached to, for example, a vacuum chamber of an ion implanter, a sputtering device, a deposition device, or other vacuum process devices, and is used in order to increase a degree of vacuum inside the vacuum chamber to a level required for a desired vacuum process. For example, a high degree of vacuum of approximately $10^{-5}$ Pa to $10^{-8}$ Pa is realized in the vacuum chamber. The controller 20 is configured as a control device different from the plurality of cryopumps 10. Alternatively, a controller may be integrally provided with each of the cryopumps 10, and the controller 20 may be configured as a combination of the plurality of controllers.

Although the cryopump system 100 is configured by four cryopumps 10 in the example shown in FIG. 1, the number of the cryopumps 10 is not particularly limited. The plurality of cryopumps may be provided in separate vacuum chambers respectively, or may be provided in one same vacuum chamber.

As shown in FIG. 2, the cryopump 10 includes a compressor 12, a cryocooler 14, a cryopump container 16, and a cryopanel 18. In addition, the cryopump 10 includes a pressure sensor 22, a rough valve 24, a purge valve 26, and a vent valve 28, and the components are provided in the cryopump container 16.

The compressor 12 is configured to collect a refrigerant gas from the cryocooler 14, to pressurize the collected refrigerant gas, and to supply the refrigerant gas to the cryocooler 14 again. The cryocooler 14 is also called an expander or a cold head, and configures a cryocooler together with the compressor 12. A thermodynamic cycle, through which chill is generated, is configured by performing circulation of the refrigerant gas between the compressor 12 and the cryocooler 14 with an appropriate combination of pressure fluctuations and volume fluctuations of the refrigerant gas in the cryocooler 14, and thereby a cooling stage of the cryocooler 14 can be cooled to a desired cryogenic temperature. Accordingly, the cryopanel 18 thermally coupled to the cooling stage of the cryocooler 14 can be cooled to a target cooling temperature (for example, 10 K to 20 K). Although the refrigerant gas is usually a helium gas, other appropriate gases may be used. In order to facilitate understanding, a direction in which the refrigerant gas flows is indicated with an arrow in FIG. 2. Although the cryocooler is, for example, a two-stage Gifford-McMahon (GM) cryocooler, the cryocooler may be a pulse tube cryocooler, a Stirling cryocooler, or other types of cryocoolers.

The cryopump container 16 is a vacuum chamber that is designed to maintain a vacuum during vacuum pumping operation of the cryopump 10 and to withstand a pressure in the ambient environment (for example, the atmospheric pressure). The cryopump container 16 has a cryopanel accommodation unit 16*a* including an intake port 17 and a cryocooler accommodation unit 16*b*. The cryopanel accommodation unit 16*a* has a dome shape in which the intake port 17 is opened and an opposite side thereof is closed, and the cryopanel 18 is accommodated therein together with the cooling stage of the cryocooler 14. The cryocooler accommodation unit 16*b* has a cylindrical shape, and has one end fixed to a room temperature portion of the cryocooler 14 and the other end connected to the cryopanel accommodation unit 16*a*. The cryocooler 14 is inserted therein. The intake port 17 is connected to the vacuum chamber of the vacuum process device via a gate valve (not shown). A gas that enters from the intake port 17 of the cryopump 10 is captured through condensation or adsorption in the cryopanel 18. Since various known configurations can be adopted as appropriate as configurations of the cryopump 10, such as the disposition and shape of the cryopanel 18, description thereof will not be made in detail.

The controller 20 may control the cryocooler 14 based on the cooling temperature of the cryopanel 18 in the vacuum pumping operation of the cryopump 10. A temperature sensor 23 that measures the temperature of the cryopanel 18 may be provided in the cryopump container 16, and the controller 20 may be connected to the temperature sensor 23 so that a temperature sensor output signal indicating the measured temperature of the cryopanel 18 is received.

In addition, in regeneration operation of the cryopump 10, the controller 20 may control the cryocooler 14, the rough valve 24, the purge valve 26, and the vent valve 28 based on a pressure in the cryopump container 16 (or if necessary, based on the temperature of the cryopanel 18 and the pressure in the cryopump container 16). The controller 20 may be connected to the pressure sensor 22 to receive a pressure sensor output signal indicating a measured pressure in the cryopump container 16. Each of the rough valve 24, the purge valve 26, and the vent valve 28 is opened and closed in accordance with a command signal input from the controller 20.

Although details will be described later, the controller 20 may be configured to control, for each of the plurality of cryopumps 10, the rough valve 24 of the cryopump 10 based on a measured pressure from the pressure sensor 22 of the cryopump 10, such that the cryopump 10 is decompressed to a first reference pressure by a rough pump 32 to maintain a vacuum, and is further decompressed to a second reference pressure lower than the first reference pressure. The controller 20 is configured to, based on the measured pressure from the pressure sensor 22 of a certain cryopump 10 of the plurality of cryopumps 10, open the rough valve 24 of a different one of the cryopumps 10 such that the different cryopump 10 is decompressed to the first reference pressure while the vacuum is maintained in the certain cryopump 10. The controller 20 is configured to compare the measured pressure from the pressure sensor 22 of the certain cryopump 10 with the first reference pressure, and to open the rough valve 24 of the different cryopump 10 when the measured pressure falls below the first reference pressure.

The internal configuration of the controller 20 is realized by an element or a circuit including a CPU and a memory of a computer as a hardware configuration and is realized by a computer program as a software configuration, but is shown in the drawings as a functional block realized in cooperation therewith. It is clear for those skilled in the art that the functional blocks can be realized in various manners in combination with hardware and software.

For example, the controller 20 can be mounted in combination with a processor (hardware) such as a central processing unit (CPU) and a microcomputer and a software program executed by the processor (hardware). Such a hardware processor may be configured by, for example, a programmable logic device such as a field programmable gate array (FPGA), or may be a control circuit such as a programmable logic controller (PLC). The software program may be a computer program for causing the controller 20 to execute the regeneration of the cryopump 10.

The pressure sensor 22 measures a pressure in the cryopump container 16, and generates a pressure sensor output signal. The pressure sensor 22 is attached to the cryopump container 16, for example, the cryocooler accommodation unit 16*b*. The pressure sensor 22 has a wide measurement range including both of a vacuum (for example, 1 to 10 Pa, which is an operation starting pressure of the cryopump 10) and the atmospheric pressure. It is desirable that the measurement range includes at least a range of a pressure that can be generated during regeneration processing. In the embodiment, an atmospheric pressure Pirani gauge (Pirani vacuum gauge that can measure the atmospheric pressure) is used as the pressure sensor 22. Alternatively, the pressure sensor 22 may be, for example, a crystal gauge or other pressure sensors that indirectly measure a pressure based on interaction between a gas and the sensor.

When referring to FIGS. 1 and 2, the rough valve 24 is attached to the cryopump container 16, for example, the cryocooler accommodation unit 16*b*. In addition, the cryopump system 100 includes a rough evacuation line 30. The rough evacuation line 30 includes the common rough pump 32 used by the plurality of cryopumps and a rough pipe 34 that merges from the rough valve 24 of each of the cryopumps 10 to the common rough pump 32. The rough valve 24 is connected to the rough pump 32 by the rough pipe 34. The rough pump 32 is a vacuum pump for evacuating the cryopump 10 to the operation starting pressure. The cryopump container 16 communicates with the rough pump 32 when the rough valve 24 is opened through control by the controller 20. The cryopump container 16 is cut off from the rough pump 32 when the rough valve 24 is closed. By opening the rough valve 24 and operating the rough pump 32, the cryopump 10 can be decompressed.

The purge valve 26 is attached to the cryopump container 16, for example, to the cryopanel accommodation unit 16*a*. The purge valve 26 is connected to a purge gas supply device (not shown) provided outside the cryopump 10. A purge gas is supplied to the cryopump container 16 when the purge valve 26 is opened through control by the controller 20. The purge gas supply to the cryopump container 16 is cut off when the purge valve 26 is closed. The purge gas may be, for example, a nitrogen gas or other dry gases. The temperature of the purge gas may be adjusted, for example, to the room temperature, or may be heated to a temperature higher than the room temperature. By opening the purge valve 26 and introducing the purge gas into the cryopump container 16, the cryopump 10 can be pressurized. In addition, the temperature of the cryopump 10 can be increased from the cryogenic temperature to the room temperature or a temperature higher than the room temperature.

The vent valve 28 is attached to the cryopump container 16, for example, the cryocooler accommodation unit 16*b*. The vent valve 28 is capable of being opened and closed through control and can be mechanically opened by a differential pressure inside and outside the cryopump container 16. The vent valve 28 is, for example, a closed-type control valve, and is configured to function also as a so-called safety valve. Since the external environment of the cryopump 10 is usually the atmospheric pressure, the vent valve 28 is opened through control or mechanically when a pressure in the cryopump container 16 reaches the atmospheric pressure or a pressure somewhat higher than the atmospheric pressure, and exhausts a fluid from the inside to the outside of the cryopump 10, thereby releasing the internal pressure.

Figure 3:
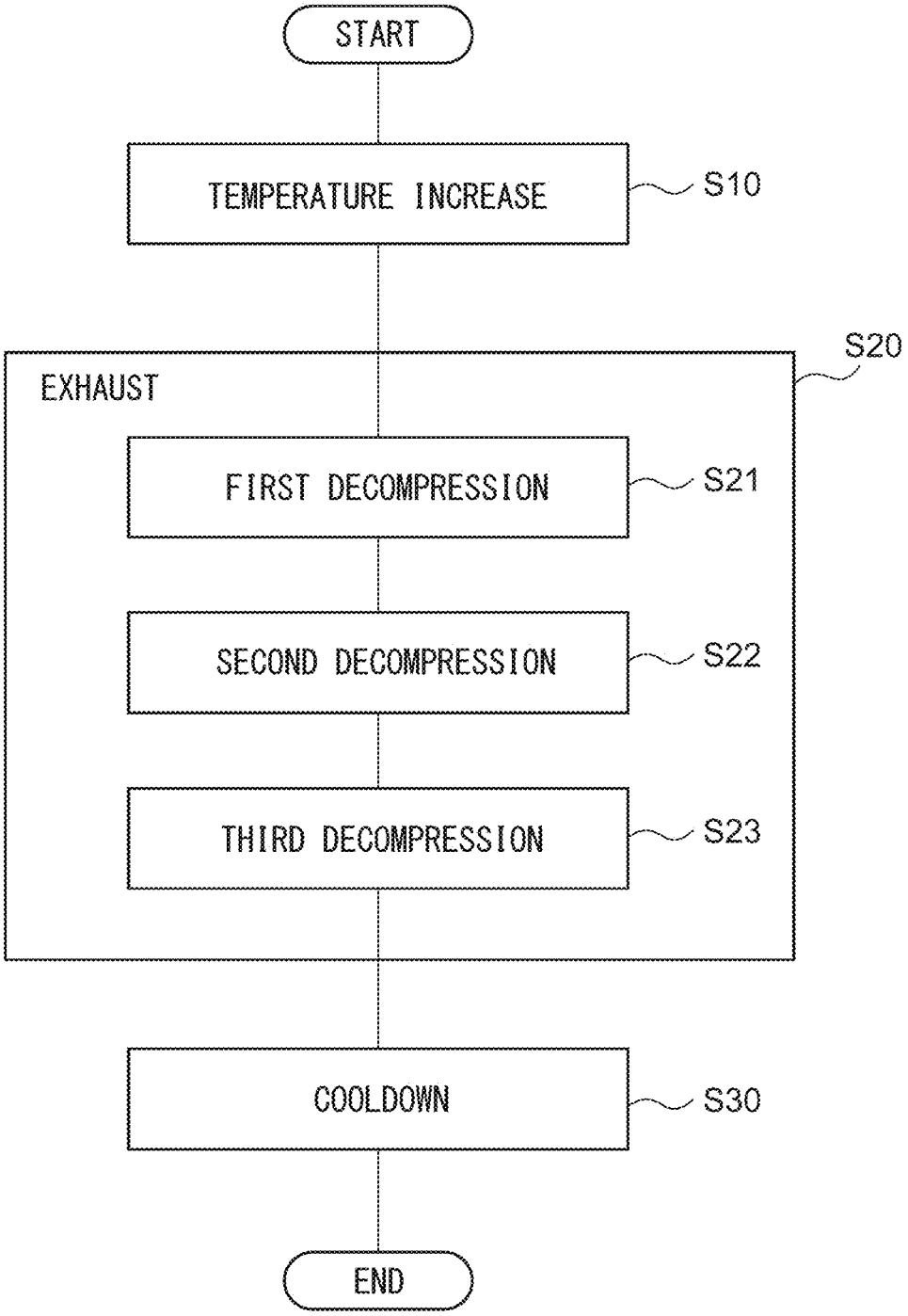
FIG. 3 is a flowchart for describing a regeneration method for a cryopump system according to the embodiment.

FIG. 3 is a flowchart for describing a regeneration method for a cryopump system according to the embodiment. The regeneration method includes a temperature increasing process (S10), an exhausting process (S20), and a cooldown process (S30), and is performed in parallel with the plurality of cryopumps 10 under the control of the controller 20. It is not essential for all of the cryopumps 10 of the cryopump system 100 to be regenerated simultaneously. While some cryopumps 10 continue vacuum pumping operation, the controller 20 may be configured to regenerate the remaining cryopumps 10.

In the temperature increasing process (S10), with a purge gas supplied to the cryopump container 16 through the purge valve 26 or other heating means, the temperature of the cryopump 10 is increased from the cryogenic temperature to the room temperature or a regeneration temperature higher than the room temperature (for example, approximately 290 K to approximately 300 K). Simultaneously, since a gas captured in the cryopump 10 is again vaporized and the purge gas is supplied, a pressure in the cryopump container 16 increases toward the atmospheric pressure or a pressure somewhat higher than the atmospheric pressure. In the temperature increasing process, the supplied purge gas and the gas vaporized again through heating can be exhausted from the cryopump container 16 to the outside through the vent valve 28. In the temperature increasing process, the rough valve 24 is usually closed.

In the temperature increasing process, the controller 20 is configured to compare, for each of the cryopumps 10, a measured temperature from the temperature sensor 23 of the cryopump 10 with the regeneration temperature, and to determine that the temperature increase of the cryopump 10 is completed in a case where the measured temperature exceeds the regeneration temperature. In a case where the measured temperature falls below the regeneration temperature, the controller 20 continues the temperature increasing process. The controller 20 may terminate the temperature increasing process immediately when the measured temperature exceeds the regeneration temperature, and start the exhausting process. Instead of this, the controller 20 may proceed from the temperature increasing process to the exhausting process via a so-called extension purge (that is, continuing to supply a purge gas even after the measured temperature exceeds the regeneration temperature for a certain period of time). When terminating the temperature increasing process, a pressure in the cryopump container 16 becomes the atmospheric pressure or a pressure somewhat higher than the atmospheric pressure.

In the exhausting process (S20), each of the cryopumps 10 is decompressed step by step through a plurality of stages of decompressing processes. The exhausting process includes, for example, a first decompressing process (S21), a second decompressing process (S22), and a third decompressing process (S23). The decompressing processes are executed consecutively by the controller 20 for each of the cryopumps 10. Decompression is performed by the rough pump 32 through the rough valve 24. In the exhausting process, the vent valve 28 is usually closed except when a purge gas is supplied.

In the first decompressing process, the cryopump container 16 is decompressed from the atmospheric pressure to the first reference pressure, and a first pressure rising rate test is executed under the first reference pressure. In the first decompressing process, so-called rough and purge (that is, evacuation of the cryopump container 16 through the rough valve 24 and the supply of a purge gas through the purge valve 26 are performed alternately one or more times) may be performed. The first decompressing process is continued until passing the first pressure rising rate test. When passing the first pressure rising rate test, the cryopump 10 proceeds to the second decompressing process.

In the second decompressing process, the cryopump container 16 is decompressed from the first reference pressure to the second reference pressure, and a second pressure rising rate test is executed under the second reference pressure. The second decompressing process is continued until passing the second pressure rising rate test. When passing the second pressure rising rate test, the cryopump 10 proceeds to the third decompressing process. Similarly, in the third decompressing process, the cryopump container 16 is decompressed from the second reference pressure to a third reference pressure, and a third pressure rising rate test is executed under the third reference pressure. The third decompressing process is continued until passing the third pressure rising rate test. When passing the third pressure rising rate test, the cryopump 10 proceeds to the cooldown process. In the second decompressing process and the third decompressing process, the purge valve 26 may be closed and a purge gas may no longer be supplied.

As is known, in a pressure rising rate (Rate of Rise; RoR) test, the degree of a pressure increase from a reference pressure when the cryopump container 16 is maintained in a vacuum and a predetermined time elapses is detected. When the degree of the pressure increase is less than a threshold, it is determined to be a pass, and when the degree is equal to or larger than the threshold, it is determined to be a fail. In order to maintain the cryopump container 16 in a vacuum, the valves provided in the cryopumps 10 are all closed.

The first reference pressure, the second reference pressure, and the third reference pressure are set in advance respectively. The second reference pressure is a pressure value lower than the first reference pressure, and the third reference pressure is a pressure value lower than the second reference pressure. The first reference pressure may be selected from, for example, a range of 600 to 50 Pa. The second reference pressure may be selected from, for example, a range of 100 to 10 Pa. The third reference pressure may be selected from, for example, a range of 10 to 1 Pa.

In the cooldown process (S30), the cryopump 10 is cooled from the regeneration temperature to the cryogenic temperature again. In this manner, regeneration is completed, and the cryopump 10 can start vacuum pumping operation again.

FIG. 4 is a table showing an example of a waiting list according to the embodiment. The controller 20 includes a first waiting list 41 defining an order in which the plurality of cryopumps 10 use the rough pump 32. In a case where the cryopump system 100 includes N (N is a natural number) cryopumps 10, the first waiting list 41 is data in which identification information (for example, identification numbers 1 to N) of each of the cryopumps 10 is associated with the order.

In the embodiment, the controller 20 is configured to generate the first waiting list 41 based on an order of completion of the temperature increases of the plurality of cryopumps 10. Accordingly, the first waiting list 41 is created during regeneration (that is, in the temperature increasing process). The first waiting list 41 is used in the first half of the exhausting process, at least in the first decompressing process.

FIG. 4 shows, as for four cryopumps (1) to (4), a case where the temperature increasing process is completed in the order of the cryopumps (3), (2), (1), and (4). In accordance with the order in which the temperature increasing process is completed earlier (in accordance with the ascending order of time required for the temperature increasing process), the cryopumps (3), (2), (1), and (4) are ordered in the first waiting list 41. Therefore, the exhausting process (that is, the first decompressing process) is started from the cryopumps (3), (2), (1), and (4) in this order according to the first waiting list 41.

In addition, the controller 20 includes a second waiting list 42 defining the order in which the plurality of cryopumps 10 use the rough pump 32. The second waiting list 42 is different from the first waiting list 41. Also the second waiting list 42 is data in which identification information (for example, an identification number) of each of the cryopumps 10 is associated with the order.

In the embodiment, the controller 20 is configured to generate the second waiting list 42 based on an order of completion of the previous regeneration of each of the plurality of cryopumps 10. Accordingly, the second waiting list 42 is created in advance before regeneration. The second waiting list 42 is used in the second half of the exhausting process, or at least the third decompressing process, for example, after the second decompressing process. In the second waiting list 42, the plurality of cryopumps 10 are divided into a plurality of groups, and the order is defined for each group. In other words, in the second waiting list 42, one or more cryopumps 10 can be set in the same order. The cryopumps 10 in a first group are preferentially processed, and the cryopumps 10 in a second group are processed after the cryopumps 10 in the first group are processed. Instead of this, the cryopumps 10 in one group may be ordered.

FIG. 4 shows a case where the previous regeneration is completed in the order of the cryopumps (3), (2), (1), and (4). In addition, as for the cryopumps (3) and (2), cooldown is completed at the approximately same time. As for the cryopumps (1) and (4), although later than the cryopumps (3) and (2), cooldown is completed at the approximately same time in the two cryopumps. In the second waiting list 42, in the order in which regeneration, that is, the cooldown process is completed later (in the descending order of time required for the cooldown process), the cryopumps (1) and (4) are ordered in the first group, and the cryopumps (3) and (2) are ordered in the second group. Therefore, according to the second waiting list 42, the second decompressing process (or the third decompressing process) is executed first on the cryopumps (1) and (4) in the first group, and then is executed on the cryopumps (3) and (2) in the second group.

Figure 5:
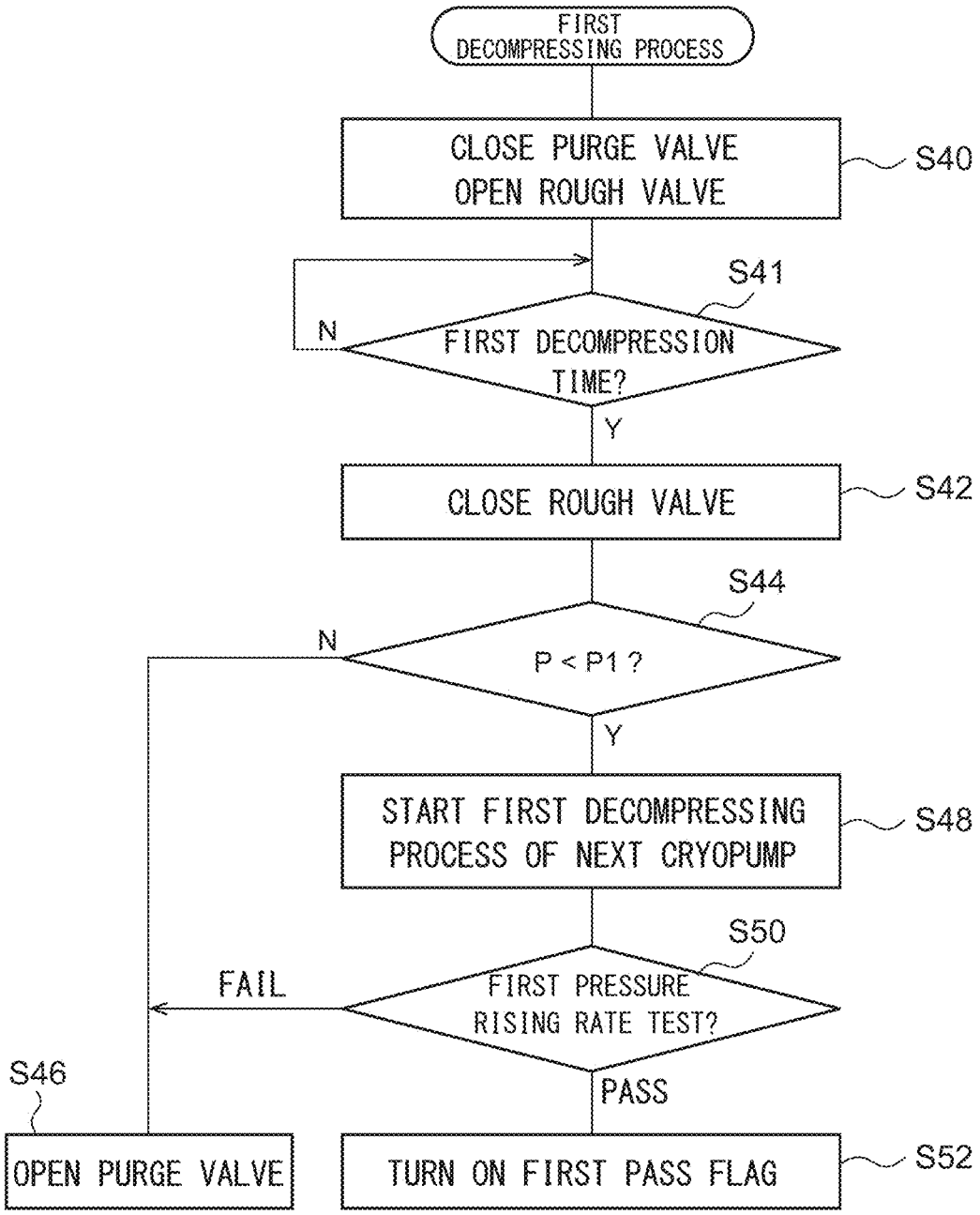
FIG. 5 is a flowchart showing an example of a first decompressing process shown in FIG. 3.

FIG. 5 is a flowchart showing an example of the first decompressing process shown in FIG. 3. The first decompressing process is executed from the first cryopump 10 in the first waiting list 41. As shown in FIG. 5, the controller 20 closes the purge valve 26, and opens the rough valve 24 (S40). In this manner, the first decompression of the cryopump 10 is performed. The first decompression extends over first decompression time (for example, approximately several tens of seconds to one minute). The controller 20 has a timer, and closes the rough valve 24 when the first decompression time has elapsed since the opening of the rough valve 24 (S41 and S42).

The controller 20 compares a measured pressure P of the cryopump 10 with a first reference pressure P1 (S44). The measured pressure P is measured by the pressure sensor 22, and is input to the controller 20. The first reference pressure P1 is, for example, 300 Pa. In a case where the measured pressure P is equal to or higher than the first reference pressure P1 (N of S44), the controller 20 opens the purge valve 26 (S46). In this case, until the first decompressing process is executed again, the cryopump 10 waits in a state where a purge gas is supplied. The controller 20 may close the purge valve 26 when the measured pressure P returns to the atmospheric pressure or after predetermined time has elapsed. As the first decompressing process is again performed after then, rough and purge is performed.

On the other hand, in a case where the measured pressure P falls below the first reference pressure P1 (Y of S44), with reference to the first waiting list 41, the controller 20 selects the next cryopump 10 (in a case where the cryopump 10, on which the first decompressing process is first performed, is the first cryopump 10, the second cryopump 10 in the first waiting list 41) according to the first waiting list 41, and starts the first decompressing process on the selected cryopump 10 (S48). That is, the controller 20 closes the purge valve 26 of the next cryopump 10 in the first waiting list 41, and opens the rough valve 24 (S40). In this manner, the first decompression (that is, the decompression to the first reference pressure P1) of the cryopump 10 is performed.

In addition, the controller 20 executes the first pressure rising rate test on the cryopump 10 on which the first decompressing process is first performed (S50). As described above, in the first pressure rising rate test, the degree of a pressure increase from the first reference pressure P1 when the cryopump 10 is maintained in a vacuum due to the closing of the rough valve 24 and first predetermined time elapses is detected. When the degree of the pressure increase is less than a first threshold, it is determined to be a pass, and when the degree is equal to or larger than the first threshold, it is determined to be a fail. In a case of passing the first pressure rising rate test, the controller 20 changes a first pass flag to on (S52). The cryopump 10 is maintained in a vacuum as it is. In a case of failing the first pressure rising rate test, the controller 20 opens the purge valve 26 (S46). In a case where an initial value of the first pass flag is off and in a case of failing the first pressure rising rate test, the first pass flag remains off.

In this manner, the controller 20 executes the first decompressing process on the plurality of cryopumps 10 consecutively. After the first decompressing process of the last (Nth) cryopump 10 in the first waiting list 41, processing returns to the first cryopump 10 again.

In a case where the first pass flag of the first cryopump 10 is turned off, the controller 20 executes the first decompressing process of the first cryopump 10 one more time. In a case where the first pass flag of the first cryopump 10 is turned on, the controller 20 skips the first decompressing process of the first cryopump 10, and proceeds to the second cryopump 10. Similarly, as for the second cryopump 10 and the subsequent cryopumps 10, consecutively, the first decompressing process is performed one more time in a case where the first pass flag is turned off. The first decompressing process is skipped and processing proceeds to the next cryopump 10 in a case where the first pass flag is turned on. When the first pass flags of all of the cryopumps 10 are turned on, the controller 20 terminates the first decompressing process, and starts the second decompressing process.

Figure 6:
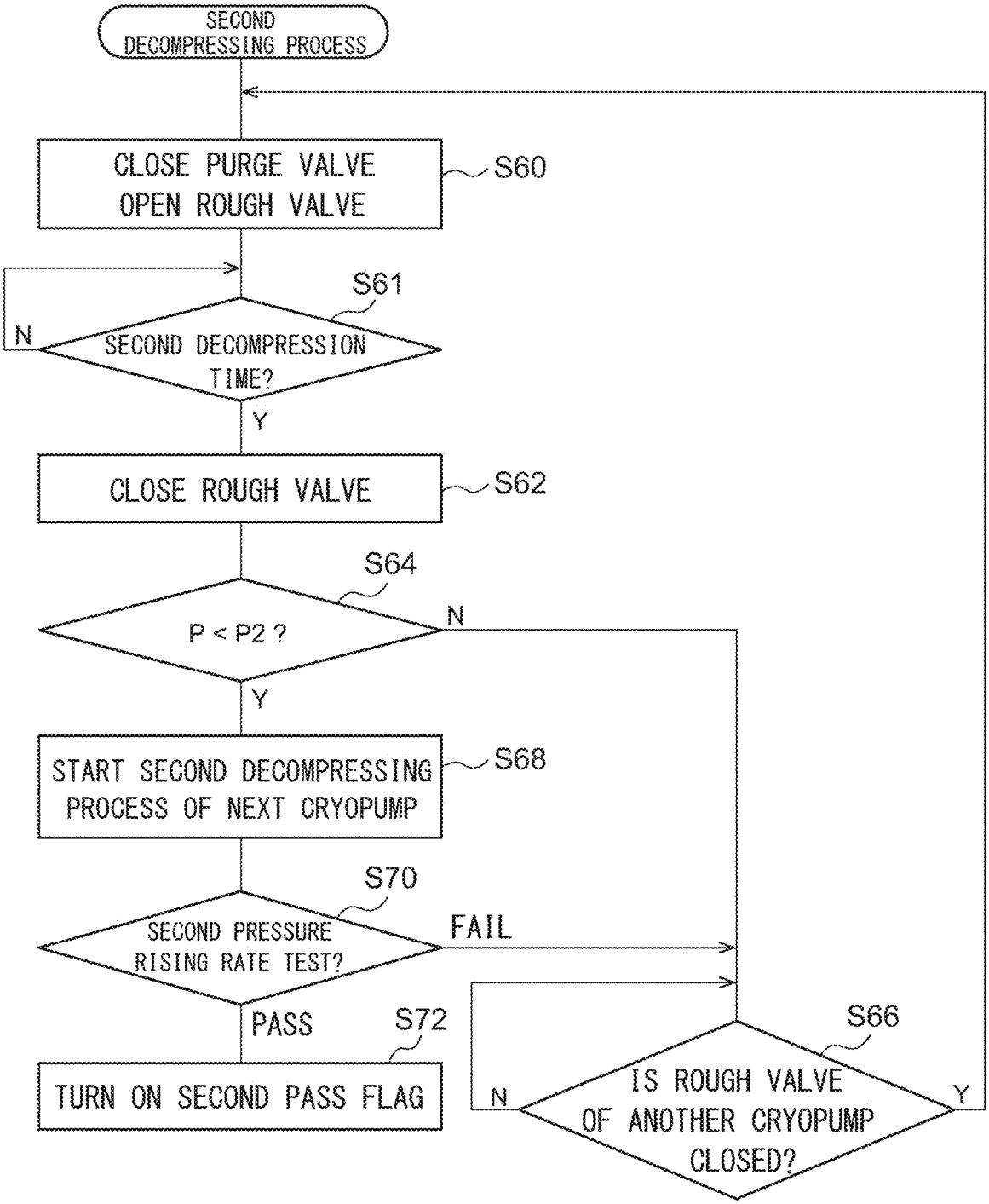
FIG. 6 is a flowchart showing an example of a second decompressing process shown in FIG. 3.

FIG. 6 is a flowchart showing an example of the second decompressing process shown in FIG. 3. The second decompressing process is executed from the cryopumps 10 in the first group in the second waiting list 42. In a case where the first group includes two or more cryopumps 10, any one of the cryopumps 10 in the first group is randomly selected (alternatively, in a case where the order is determined in the first group, the cryopump 10 is selected in accordance with the order). As shown in FIG. 6, the controller 20 closes the purge valve 26, and opens the rough valve 24 (S60). In this manner, the second decompression of the cryopump 10 is performed. The second decompression extends over second decompression time (for example, approximately several minutes). That is, the controller 20 closes the rough valve 24 when the second decompression time has elapsed since the opening of the rough valve 24 (S61 and S62).

The controller 20 compares the measured pressure P of the cryopump 10 with a second reference pressure P2 (S64). The second reference pressure P2 is, for example, 50 Pa. In a case where the measured pressure P is equal to or higher than the second reference pressure P2 (N of S64), the controller 20 checks whether or not the rough valve 24 of another cryopump 10 is closed (S66). In a case where the rough valve 24 of any other cryopump 10 is open (N of S66), the controller 20 checks the rough valve 24 again (S66). In a case where the rough valves 24 of all of the other cryopumps 10 are closed (Y of S66), the second decompressing process is executed on one more time.

On the other hand, in a case where the measured pressure P falls below the second reference pressure P2 (Y of S64), with reference to the second waiting list 42, the controller 20 selects the next cryopump 10 (in a case where the second decompressing process is performed on the cryopump 10 in the first group, another cryopump 10 included in the first group) according to the second waiting list 42, and starts the second decompressing process on the selected cryopump 10 (S68). The controller 20 may randomly select another cryopump 10 from the first group, may select another cryopump from the first group in accordance with the order, or may select another cryopump based on priority (for example, a cryopump having longer time elapsed from the closing of the rough valve 24 may be selected first). However, in a case where the first group includes only one cryopump 10, the controller 20 skips this step (S68).

In addition, the controller 20 executes the second pressure rising rate test on the cryopump 10 on which the second decompressing process is performed first (S70). As described above, in the second pressure rising rate test, the degree of a pressure increase from the second reference pressure P2 when the cryopump 10 is maintained in a vacuum due to the closing of the rough valve 24 and predetermined second time elapses is detected. When the degree of the pressure increase is less than a second threshold, it is determined to be a pass, and when the degree is equal to or larger than the second threshold, it is determined to be a fail. In a case of passing the second pressure rising rate test, the controller 20 changes a second pass flag to on (S72). The cryopump 10 is maintained in a vacuum as it is. In a case of failing the second pressure rising rate test, the controller 20 checks whether or not the rough valve 24 of the other cryopump 10 is closed (S66). In a case where an initial value of the second pass flag is off and in a case of failing the second pressure rising rate test, the second pass flag remains off.

In this manner, the controller 20 executes the second decompressing process on the cryopumps 10 in the first group consecutively. When the second pass flags of all of the cryopumps 10 in the first group are turned on, as for the cryopumps 10 in the first group, the controller 20 terminates the second decompressing process, and starts the third decompressing process.

The third decompressing process is the same as the second decompressing process. However, instead of parameters used in the second decompressing process, parameters of the third decompressing process are used. That is, instead of the second decompression time and the second reference pressure, third decompression time and the third reference pressure are used. The third reference pressure is, for example, 10 Pa. In addition, instead of the second pressure rising rate test, the third pressure rising rate test is executed. In a case of passing the third pressure rising rate test, the controller 20 changes a third pass flag of the cryopump 10 to on, and starts the cooldown process.

When the controller 20 executes the third decompressing process on the cryopumps 10 in the first group consecutively, and the third pass flags of all of the cryopumps 10 in the first group are turned on, as for the cryopumps 10 in the second group, the controller 20 executes the second decompressing process, the third decompressing process, and the cooldown process. When the cooldown process is terminated for all of the groups, the regeneration of the cryopump system 100 is completed.

The configuration of the cryopump system 100 according to the embodiment has been explained hereinbefore. Next, the operation will be described.

As vacuum pumping operation is continued, a gas accumulates in the cryopump 10. In order to exhaust the accumulated gas to the outside, the regeneration of the cryopump 10 is performed. The gate valve provided in the intake port 17 is closed when the regeneration starts, and the cryopump 10 is cut off from the vacuum chamber of the vacuum process device.

The regeneration is simultaneously started for the plurality of cryopumps 10, and temperatures increase in parallel with each other. The amount of captured gas can be different for each of the cryopumps 10. The cryopump 10, which has captured a large amount of gas, takes time to increase the temperature. In addition, the cryopump system 100 includes the cryopumps 10 having different sizes, for example, some cryopumps 10 have a diameter of 8 inches and some other cryopumps have a diameter of 12 inches. The large cryopump 10 takes time to increase the temperature compared with a small cryopump. Even when the cryopumps 10 have the same size, there can be subtle differences in behavior for each of the cryopumps 10 due to individual differences. Under such circumstances, even when the regenerations of the plurality of cryopumps 10 have been simultaneously started, timing when the temperature increase is completed is different between the cryopumps 10, and timing when the regeneration of each of the cryopumps 10 is completed is different without completely synchronizing respective processes of regeneration with each other.

In the exhausting process, each of the cryopumps 10 is evacuated by the rough pump 32. The number of the rough pumps 32 is, in a case where the number is large, smaller than the number of the cryopumps 10, and is usually only one. Since the regenerations of the plurality of cryopumps 10 are not synchronized with each other, the pressures of the respective cryopumps 10 can also be different from each other at a certain time point in the exhausting process. That is, a pressure difference can occur between the different cryopumps 10. When the rough valves 24 of the plurality of cryopumps 10 are simultaneously opened and the cryopumps 10 are simultaneously connected to the rough pump 32, backflow from the relatively high-pressure cryopumps 10 to the relatively low-pressure cryopumps 10 through the rough evacuation line 30 can occur due to the pressure difference between the cryopumps 10. Such gas backflow can cause an increase in regeneration time or the contamination of the cryopumps 10, which is not desirable. Thus, the rough pump 32 is connected to only one cryopump 10 at a time. For this reason, the controller 20 is configured to, when the rough valve 24 of a certain cryopump 10 is open, close the rough valves 24 of all of the other cryopumps 10.

The exhausting process starts consecutively from the cryopump 10 which has completed a pressure rising process first. Accordingly, at the beginning of the exhausting process, only one or a small number of the cryopumps 10, in which a temperature increase is completed first, appear in the first waiting list 41, and the first decompressing process starts therefrom. As the cryopumps 10, in which a temperature increase is completed, increase, the cryopumps 10 also appear in the first waiting list 41, and the number of the cryopumps 10 which has participated in the first decompressing process increases.

According to the first waiting list 41, in the first decompressing process, the vacuum maintenance (and the first pressure rising rate test) of one cryopump 10 and the first decompression of another the cryopump 10 are simultaneously performed. When the first decompression is executed on the one cryopump 10 at a certain time point in the first decompressing process, the remaining cryopumps 10 are maintained in a vacuum after the decompression to the first reference pressure, or are maintained at the atmospheric pressure as a purge gas is introduced. In the cryopumps 10 which are maintained in a vacuum, the pressures can increase slightly from the first reference pressure due to the desorption of gas molecules adsorbed on inner surfaces of the cryopumps 10. When all of the cryopumps 10 pass the first pressure rising rate test, the second decompressing process starts.

According to the second waiting list 42, the second decompressing process and the third decompressing process are performed preferentially on the cryopump 10 requiring longer time for the cooldown process. Also in the second decompressing process, the vacuum maintenance (and the second pressure rising rate test) of one cryopump 10 and the second decompression of another cryopump 10 are simultaneously performed. When the second decompression is executed on one cryopump 10 at a certain time point in the second decompressing process, the cryopump 10, in which the second decompressing process is yet to be started, among the remaining cryopumps 10, is maintained in a vacuum at the first reference pressure or a pressure slightly higher than the first reference pressure, and the other cryopumps 10 are maintained in a vacuum at the second reference pressure or a pressure slightly higher than the second reference pressure.

In the cryopump 10 which has passed the second pressure rising rate test, the third decompressing process starts. Similarly, also in the third decompressing process, the vacuum maintenance (and the third pressure rising rate test) of one cryopump 10 and the third decompression of another cryopump 10 are simultaneously performed. When the third decompression is executed on one cryopump 10 at a certain time point in the third decompressing process, the remaining cryopumps 10 are maintained in a vacuum at respective pressures corresponding to stages of decompressing processes.

In the cryopump 10 which has passed the third pressure rising rate test, the cooldown process starts. Since the second decompressing process and the third decompressing process are performed preferentially on the cryopump 10 requiring longer time for the cooldown process, the cooldown process is also performed first from the cryopump 10 requiring longer time therefor. When the cooldown process is terminated for all of the cryopumps 10 in this manner, the regeneration of the cryopump system 100 is completed, and vacuum pumping operation is resumed.

Herein, comparison between a case where one cryopump 10 is decompressed at once from the atmospheric pressure to a target pressure and a case where the decompression is suspended once at an intermediate pressure in the middle of decompressing, the decompression temporarily waits (is temporarily maintained in a vacuum), and the decompression is resumed so that the decompression to the target pressure is finally performed is considered. It is evident that the latter is predicted to require longer time for decompressing to the target pressure since there is suspension and waiting in the middle of decompressing. However, the present inventor has found out that there can be a case where there is almost no difference in the required time between the former and the latter. Based on the new findings, the present inventor has proposed causing one cryopump 10 to wait at an intermediate pressure and causing another cryopump 10 to use the rough pump 32 in the meantime. Accordingly, it is expected that the total time required for the regenerations of the plurality of cryopumps 10 can be shortened.

Figure 7A:
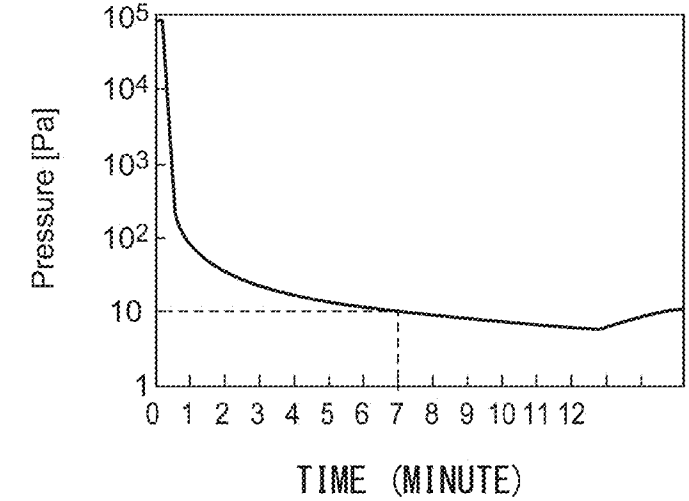
FIGS. 7A to 7D are graphs showing changes in a pressure over time when decompressing the cryopump with a rough pump.
Figure 7B:
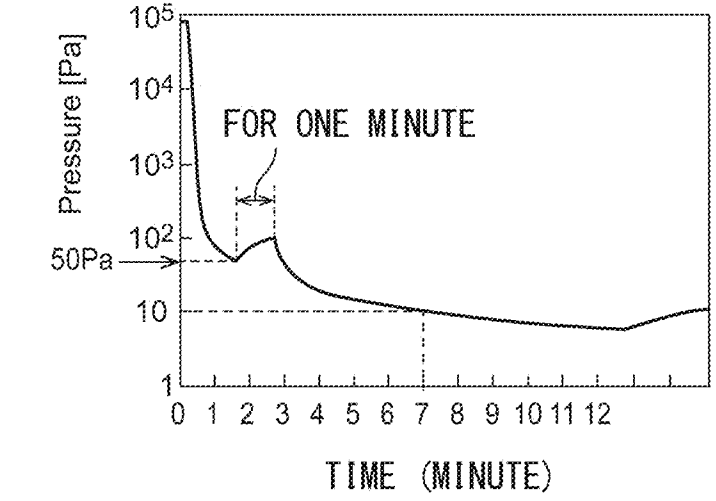
Figure 7C:
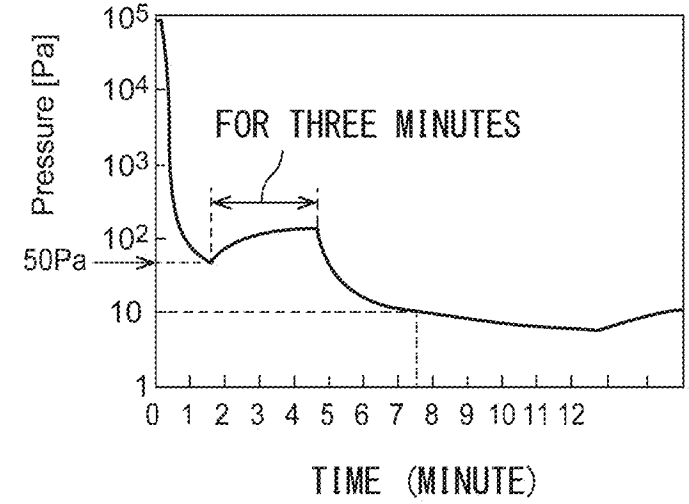
Figure 7D:
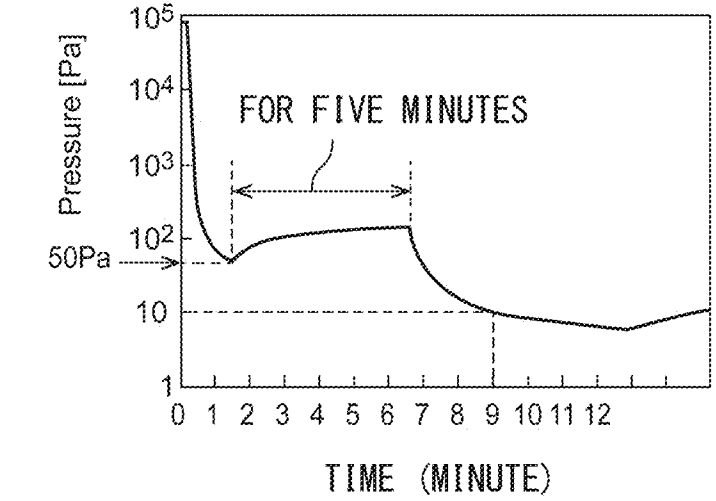

FIGS. 7A to 7D are graphs showing changes in a pressure over time when decompressing the cryopump with the rough pump. Each graph shows experimental results by the present inventor. FIG. 7A shows pressure changes in a case of decompressing the cryopump at once from the atmospheric pressure ($10^5$ Pa) to the target pressure (10 Pa). FIG. 7B shows pressure changes in a case where decompression is suspended at the intermediate pressure (50 Pa) in the middle of decompressing from the atmospheric pressure, the decompression waits for one minute, and the decompression is resumed so that the decompression is performed to the target pressure. FIGS. 7C and 7D show pressure changes in a case where waiting time is set to three minutes and five minutes, respectively.

As shown in FIG. 7A, in a case of decompressing the cryopump at once from the atmospheric pressure to the target pressure, it takes approximately seven minutes. As shown in FIG. 7B, also in a case of waiting for one minute at the intermediate pressure of 50 Pa, time required for decompressing to the target pressure is approximately seven minutes. Surprisingly, despite waiting in the middle of decompressing, there is no change in time required for decompressing to the target pressure compared with a case of decompressing at once. When the waiting time is subtracted from the required time, it is possible to acquire time for which the cryopump occupies the rough pump. While the occupancy time is seven minutes in FIG. 7A, the occupancy time is shortened to six minutes in FIG. 7B. Similarly, as shown in FIG. 7C, in a case of waiting for three minutes at the intermediate pressure, time required for decompressing to the target pressure is approximately seven and a half minutes, and rough pump occupancy time is shortened to four and a half minutes. As shown in FIG. 7D, in a case of waiting for five minutes at the intermediate pressure, time required for decompressing to the target pressure is approximately nine minutes, and rough pump occupancy time is shortened to four minutes.

By using waiting time in decompressing another cryopump, the temporal utilization efficiency of the rough pump increases. For time for which only one cryopump can be decompressed when decompressing at once from the atmospheric pressure to the target pressure, one more (or more than one) cryopump can be decompressed. For example, in the cryopump system including four cryopumps, in a case of decompressing the four cryopumps at once consecutively, total time required for decompression is approximately 28 minutes. In contrast, in a case of waiting for five minutes at the intermediate pressure of 50 Pa, the rough pump occupancy time of each cryopump is four minutes. Thus, total time required for decompression can ideally be shortened to 16 minutes.

Since the cryopump is maintained in a vacuum during waiting time, a pressure in the cryopump somewhat increases due to the desorption of gas molecules adsorbed on the inner surface of the cryopump. In FIG. 7B, the pressure has increased to approximately 100 Pa due to one minute of vacuum maintenance. In FIG. 7C, the pressure has increased to approximately 105 Pa due to three minutes of vacuum maintenance. In FIG. 7D, the pressure has increased to approximately 105 Pa due to five minutes of vacuum maintenance.

According to FIGS. 7B to 7D, it can be seen that a decompression speed is high immediately after maintaining the cryopump in a vacuum and the decompression is resumed compared with immediately before maintaining the cryopump in a vacuum. This is considered to be attributable to the desorption of gas molecules while maintaining the cryopump in a vacuum. The desorbed gas can be adsorbed again on the inner surface of the cryopump. However, in such re-adsorption, the gas molecules are adsorbed in a shallow region in a depth direction from the surface. For this reason, it is easy to desorb the gas molecules again when the decompression is resumed, and to exhaust the gas molecules from the cryopump. In a case where the cryopump is maintained at the atmospheric pressure instead of being maintaining in a vacuum, such an improvement in decompression speed cannot be obtained when the decompression is resumed.

Figure 8A:
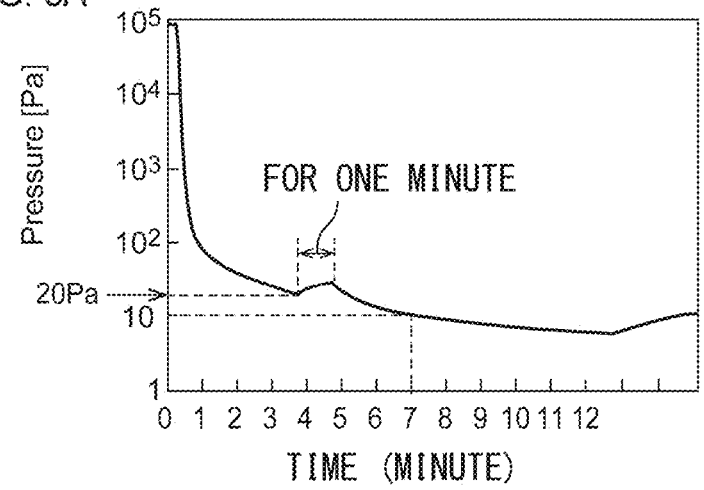
FIGS. 8A to 8C are graphs showing changes in a pressure over time when decompressing the cryopump with the rough pump.
Figure 8B:
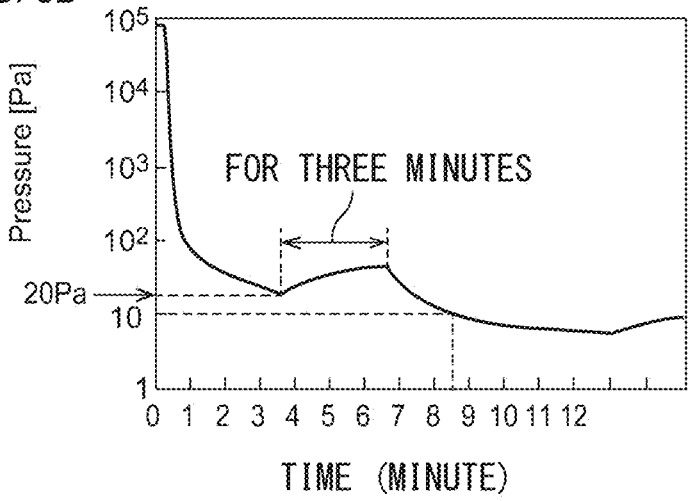
Figure 8C:
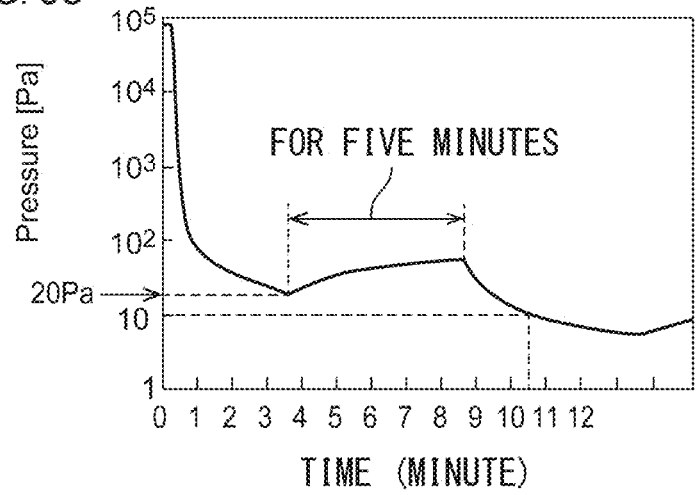

FIGS. 8A to 8C are graphs showing changes in a pressure over time when decompressing the cryopump with the rough pump. FIGS. 8A to 8C show pressure changes in a case where the intermediate pressure is set to 20 Pa and waiting time is set to one minute, three minutes, and five minutes, respectively. As shown in FIG. 8A, in a case of waiting for one minute at the intermediate pressure of 20 Pa, time required for decompressing to the target pressure is approximately seven minutes, and rough pump occupancy time is six minutes. In FIG. 8B, in a case of waiting for three minutes at the intermediate pressure, time required for decompressing to the target pressure is approximately eight and a half minutes, and rough pump occupancy time is five and a half minutes. In FIG. 8C, in a case of waiting for five minutes at the intermediate pressure, time required for decompressing to the target pressure is approximately ten and a half minutes, and rough pump occupancy time is five and a half minutes. Therefore, even when the intermediate pressure is set to different values, it is expected to obtain the same time reduction.

As described hereinbefore, in the present embodiment, the controller 20 is configured such that the plurality of cryopumps 10 are consecutively decompressed to the first reference pressure by the rough pump 32 and thereafter a vacuum is maintained in the cryopumps 10 decompressed to the first reference pressure, and the plurality of cryopumps 10 are further decompressed to the second reference pressure lower than the first reference pressure by the rough pump 32. Further, the controller 20 is configured to decompress one cryopump 10 of the plurality of cryopumps 10 to the first reference pressure while the vacuum is maintained in another cryopump 10 of the plurality of cryopumps 10.

More specifically, the controller 20 controls, for each of the plurality of cryopumps 10, the rough valve 24 of the cryopump 10 based on a measured pressure from the pressure sensor 22 of the cryopumps 10, such that the cryopump 10 is decompressed to the first reference pressure by the rough pump 32 and thereafter a vacuum is maintained in the cryopump 10, and is further decompressed to the second reference pressure lower than the first reference pressure. The controller 20 is configured to, based on the measured pressure from the pressure sensor 22 of a first one of the cryopumps 10, open the rough valve 24 of a second one of the cryopumps 10 such that the second one of the cryopumps 10 is decompressed to the first reference pressure while the vacuum is maintained in the first one of the cryopumps 10. For example, the controller 20 is configured to compare the measured pressure from the pressure sensor 22 of the first one of the cryopumps 10 with the first reference pressure, and to open the rough valve 24 of the second one of the cryopumps 10 when the measured pressure falls below the first reference pressure.

As described above, by combining the waiting of one cryopump 10 at the intermediate pressure (the vacuum being maintained) with the decompression of another cryopump 10 down to the intermediate pressure, the temporal utilization efficiency of the rough pump 32 is increased, and thus the regeneration time can be shortened.

The controller 20 includes the first waiting list 41 defining the order in which the plurality of cryopumps 10 use the rough pump 32. The controller 20 is configured to select a cryopump 10 from the plurality of cryopumps 10 according to the first waiting list 41 as the first one of the cryopumps 10, and to select another cryopump 10 next to the cryopump 10 according to the first waiting list 41 as the second one of the cryopumps 10. Since the rough valve 24 of the cryopump 10 selected according to the first waiting list 41 is opened, simultaneously opening the plurality of rough valves 24 (that is, simultaneously connecting the plurality of cryopumps 10 to the rough pump 32) is avoided.

The controller 20 is configured to generate the first waiting list 41 based on the order of completion of the temperature increases of the plurality of cryopumps 10. Each of the cryopumps 10 includes the temperature sensor 23 that measures the temperature of the cryopump 10. The controller 20 is configured to compare a measured temperature from the temperature sensor 23 of the cryopump 10 with the regeneration temperature, and to determine that the temperature increase of the cryopump 10 is completed when the measured temperature exceeds the regeneration temperature.

In this manner, the plurality of cryopumps 10 can be arranged consecutively in the first waiting list 41 from the cryopump 10 in which a temperature increase is completed first. Since the exhausting process can be promptly started consecutively from the cryopump 10 in which a temperature increase is completed first, regeneration time can be shortened.

The controller 20 includes the second waiting list 42 that defines the order, in which the plurality of cryopumps 10 use the rough pump 32, and is different from the first waiting list 41. The controller 20 selects a cryopump 10 from the plurality of cryopumps 10 according to the second waiting list 42 and to control the rough valve 24 of the selected cryopump 10 based on a measured pressure from the pressure sensor 22 of the selected cryopump 10 such that the selected cryopump 10 is decompressed to the second reference pressure and thereafter a vacuum is maintained in the selected cryopump 10, and the selected cryopump 10 is further decompressed to a third reference pressure lower than the second reference pressure. In addition, the controller 20 is configured to, based on the measured pressure from the pressure sensor 22 of the selected cryopump 10, open the rough valve 24 of a cryopump 10 next to the selected cryopump 10 according to the second waiting list 42 such that the next cryopump 10 is decompressed to the second reference pressure while the vacuum is maintained in the selected cryopump 10. In this manner, even in the second decompressing process, by combining vacuum maintenance with decompression, the temporal utilization efficiency of the rough pump 32 increases, and thus regeneration time can be shortened.

The controller 20 is configured to generate the second waiting list 42 based on the order of completion of the previous regenerations of the plurality of cryopumps 10. In this manner, the plurality of cryopumps 10 can be arranged in the second waiting list 42 consecutively from the cryopump 10 which requires longer time for regeneration completion or cooldown completion. Since the cryopump 10 which requires longer time for regeneration completion is preferentially cooled again, regeneration time can be shortened.

The controller 20 is configured to execute, for each of the plurality of cryopumps 10 while the vacuum is maintained in the cryopump 10, the first pressure rising rate test on the cryopump 10 under the first reference pressure based on the measured pressure from the pressure sensor 22 of the cryopump 10. In this manner, the first pressure rising rate test on one cryopump 10 and the decompression of another cryopump 10 are simultaneously performed. This also helps shorten regeneration time.

In the existing regeneration sequence, each cryopump can be continuously decompressed from the atmospheric pressure to a final target pressure (for example, the operation starting pressure of the cryopump). In this case, from the experience of the present inventor, a cryopump that tends to lose in competition for the rough pump appears in some cases under various circumstances such as the size and individual differences of the cryopump. The regeneration completion of this cryopump is significantly delayed compared with other cryopumps, and accordingly, the total regeneration time of the cryopump system can be considerably long.

In contrast, in the present embodiment, the controller 20 is configured to further decompress the plurality of cryopumps 10 consecutively to the second reference pressure in a case where all of the plurality of cryopumps 10 have passed the first pressure rising rate test. By proceeding to the second decompressing process after the first decompressing process is completed for all of the cryopumps 10, the appearance of the cryopump 10 that tends to lose in the competition for the rough pump 32 is avoided, and thus regeneration time can be shortened.

In the present embodiment, the first reference pressure is selected from a range of 600 to 50 Pa, and the second reference pressure is selected from a range of 100 to 10 Pa. In this manner, advantageous effects of a rough pump utilization efficiency improvement and the subsequent reduction of regeneration time are expected. In addition, since the first reference pressure is lower than the triple point pressure of water (611 Pa), the liquefaction of water vapor in the first decompressing process is avoided. Although the cryopump 10 usually includes activated carbon as adsorbent, the first reference pressure is preferably 300 Pa or lower to efficiently dehydrate the activated carbon through regeneration.

The present invention has been described based on the example. It is clear for those skilled in the art that the present invention is not limited to the embodiment, various design changes are possible, various modification examples are possible, and such modification examples are also within the scope of the present invention. Various characteristics described related to one embodiment are also applicable to the other embodiment. A new embodiment generated through combination also has the effects of each of the combined embodiments.

Although the regeneration exhausting process includes three stages of decompressing processes in the embodiment described above, the exhausting process may be performed through two stages of decompressing processes in one embodiment. In this case, the first reference pressure may be selected from a range of 600 to 10 Pa, and preferably from a range of 300 to 20 Pa. The second reference pressure may be selected from a range of 10 to 1 Pa, which is the operation starting pressure of the cryopump 10.

Although the first waiting list 41 is created according to the order of completion of temperature increases during regeneration in the embodiment described above, the first waiting list 41 may be created in advance before regeneration in one embodiment. For example, the first waiting list 41 may be determined based on the order of completion of the previous regenerations of plurality of cryopumps, or the order of time required for cooldown in the previous regeneration. Time required for the entire regeneration or cooldown is considered to be related to time required for the temperature increasing process. That is, the cryopump of which the temperature is increased first is predicted to be cooled first. Therefore, the first waiting list 41 may be determined according to the ascending order of time required for the entire regeneration or cooldown. In addition, in the first waiting list 41, the plurality of cryopumps 10 may be divided into a plurality of groups as in the second waiting list 42.

In addition, the second waiting list 42 is created before regeneration in the embodiment described above, but may be created during regeneration in one embodiment. For example, the second waiting list 42 may be created based on the first waiting list 41. As described above, the cryopump of which the temperature is increased first is predicted to be cooled first. Therefore, the second waiting list 42 may be determined in the descending order of time required for the temperature increasing process. For example, the second waiting list 42 may be in the reverse order of the first waiting list 41. In addition, in the second waiting list 42, the plurality of cryopumps 10 may be simply ordered without grouping as in the first waiting list 41.

Although the first waiting list 41 and the second waiting list 42 are different from each other in the embodiment described above, it is not essential, and the one same waiting list may be used throughout the exhausting process.

Although the present invention has been described using specific phrases based on the embodiment, the embodiment merely shows one aspect of the principles and applications of the present invention, and many modification examples and changes in disposition are allowed without departing from the gist of the present invention defined in the claims.

It should be understood that the invention is not limited to the above-described embodiment, but may be modified into various forms on the basis of the spirit of the invention. Additionally, the modifications are included in the scope of the invention.

What is claimed is:

1. A cryopump system comprising:

a plurality of cryopumps, each cryopump comprising a rough valve connecting the cryopump to a common rough pump and a pressure sensor measuring a pressure in the cryopump; and a controller that controls, for each of the plurality of cryopumps, the rough valve of the cryopump based on a measured pressure from the pressure sensor of the cryopump such that the cryopump is decompressed to a first reference pressure by the common rough pump and thereafter a vacuum is maintained in the cryopump, and the cryopump is further decompressed to a second reference pressure lower than the first reference pressure by the common rough pump, wherein the controller is configured to, based on the measured pressure from the pressure sensor of a first one of the cryopumps, open the rough valve of a second one of the cryopumps such that the second one of the cryopumps is decompressed to the first reference pressure while the vacuum is maintained in the first one of the cryopumps, and wherein the controller is configured to compare the measured pressure from the pressure sensor of the first one of the cryopumps with the first reference pressure, and to open the rough valve of the second one of the cryopumps when the measured pressure falls below the first reference pressure.

2. The cryopump system according to claim 1, wherein the controller is configured to execute, for each of the plurality of cryopumps while the vacuum is maintained in the cryopump, a first pressure rising rate test under the first reference pressure based on the measured pressure from the pressure sensor of the cryopump.

3. The cryopump system according to claim 2, wherein the controller is configured to further decompress the plurality of cryopumps consecutively to the second reference pressure in a case where all of the plurality of cryopumps pass the first pressure rising rate test.

4. A cryopump system comprising:

a plurality of cryopumps, each cryopump comprising a rough valve connecting the cryopump to a common rough pump and a pressure sensor measuring a pressure in the cryopump; and a controller that controls, for each of the plurality of cryopumps, the rough valve of the cryopump based on a measured pressure from the pressure sensor of the cryopump such that the cryopump is decompressed to a first reference pressure by the common rough pump and thereafter a vacuum is maintained in the cryopump, and the cryopump is further decompressed to a second reference pressure lower than the first reference pressure by the common rough pump, wherein the controller is configured to, based on the measured pressure from the pressure sensor of a first one of the cryopumps, open the rough valve of a second one of the cryopumps such that the second one of the cryopumps is decompressed to the first reference pressure while the vacuum is maintained in the first one of the cryopumps, and wherein the controller comprises a first waiting list defining an order in which the plurality of cryopumps use the common rough pump, and the controller is configured to select a cryopump from the plurality of cryopumps according to the first waiting list as the first one of the cryopumps, and to select another cryopump next to the cryopump according to the first waiting list as the second one of the cryopumps.

5. The cryopump system according to claim 4, wherein the controller is configured to generate the first waiting list based on an order of completion of temperature increases of the plurality of cryopumps, and each of the cryopumps includes a temperature sensor that measures a temperature in the cryopump, and the controller is configured to compare a measured temperature from the temperature sensor of the cryopump with a regeneration temperature, and to determine that a temperature increase of the cryopump is completed when the measured temperature exceeds the regeneration temperature.

6. The cryopump system according to claim 4, wherein the controller comprises a second waiting list defining an order in which the plurality of cryopumps use the common rough pump and being different from the first waiting list, the controller is configured to select a cryopump from the plurality of cryopumps according to the second waiting list and to control the rough valve of the selected cryopump based on a measured pressure from the pressure sensor of the selected cryopump such that the selected cryopump is decompressed to the second reference pressure and thereafter a vacuum is maintained in the selected cryopump, and the selected cryopump is further decompressed to a third reference pressure lower than the second reference pressure, and the controller is configured to, based on the measured pressure from the pressure sensor of the selected cryopump, open the rough valve of a cryopump next to the selected cryopump according to the second waiting list such that the next cryopump is decompressed to the second reference pressure while the vacuum is maintained in the selected cryopump.

7. The cryopump system according to claim 6, wherein the controller generates the second waiting list based on an order of completion of previous regenerations of the plurality of cryopumps.

8. A cryopump system comprising:

a plurality of cryopumps, each cryopump comprising a rough valve connecting the cryopump to a common rough pump and a pressure sensor measuring a pressure in the cryopump; and a controller that controls, for each of the plurality of cryopumps, the rough valve of the cryopump based on a measured pressure from the pressure sensor of the cryopump such that the cryopump is decompressed to a first reference pressure by the common rough pump and thereafter a vacuum is maintained in the cryopump, and the cryopump is further decompressed to a second reference pressure lower than the first reference pressure by the common rough pump, wherein the controller is configured to, based on the measured pressure from the pressure sensor of a first one of the cryopumps, open the rough valve of a second one of the cryopumps such that the second one of the cryopumps is decompressed to the first reference pressure while the vacuum is maintained in the first one of the cryopumps, and wherein the first reference pressure is selected from a range of 600 to 50 Pa, and the second reference pressure is selected from a range of 100 to 10 Pa.

9. A control device for a cryopump system, the cryopump system including a plurality of cryopumps connected to a common rough pump, each cryopump comprising a rough valve connecting the cryopump to the common rough pump and a pressure sensor measuring a pressure in the cryopump, the control device comprising:

a controller configured such that the plurality of cryopumps are consecutively decompressed to a first reference pressure by the common rough pump and thereafter a vacuum is maintained in the cryopumps decompressed to the first reference pressure, and the plurality of cryopumps are further decompressed to a second reference pressure lower than the first reference pressure by the common rough pump, wherein the controller is configured to, based on a measured pressure from the pressure sensor of a first one of the cryopumps, open the rough valve of a second one of the cryopumps such that the second one of the cryopumps is decompressed to the first reference pressure while the vacuum is maintained in the first one of the cryopumps, and wherein the controller is configured to compare the measured pressure from the pressure sensor of the first one of the cryopumps with the first reference pressure, and to open the rough valve of the second one of the cryopumps when the measured pressure falls below the first reference pressure.

10. A regeneration method for a cryopump system, the cryopump system including a plurality of cryopumps connected to a common rough pump, each cryopump comprising a rough valve connecting the cryopump to the common rough pump and a pressure sensor measuring a pressure in the cryopump, the regeneration method comprising:

decompressing the plurality of cryopumps consecutively to a first reference pressure with the common rough pump;

maintaining a vacuum in the cryopumps decompressed to the first reference pressure; and further decompressing the plurality of cryopumps to a second reference pressure lower than the first reference pressure with the common rough pump, wherein the decompressing to the first reference pressure includes, based on a measured pressure from the pressure sensor of a first one of the cryopumps, opening the rough valve of a second one of the cryopumps such that the second one of the cryopumps is decompressed to the first reference pressure while the vacuum is maintained in the first one of the cryopumps, and wherein the opening includes comparing the measured pressure from the pressure sensor of the first one of the cryopumps with the first reference pressure, and opening the rough valve of the second one of the cryopumps when the measured pressure falls below the first reference pressure.

* * * * *